US005647154A

United States Patent [19]

Groves

[11] Patent Number: 5,647,154

[45] Date of Patent: Jul. 15, 1997

[54] DECORATIVE WINDOW WELL SHIELD

[76] Inventor: Bryan H. Groves, 9258 Jasmine Way, Fox River Grove, Ill. 60021

[21] Appl. No.: 542,781

[22] Filed: Oct. 13, 1995

[51] Int. Cl.[6] ..... G09F 7/02

[52] U.S. Cl. ..... 40/584; 40/611

[58] Field of Search ..... 40/611, 594, 908, 40/545, 564, 584; 52/107

[56] References Cited

U.S. PATENT DOCUMENTS

| | | | |
|---|---|---|---|
| D. 291,430 | 8/1987 | Vartanian et al. . | |
| 2,324,398 | 7/1943 | Kahr . | |
| 2,577,667 | 12/1951 | Waite . | |
| 2,898,638 | 8/1959 | Druckhamer | 52/107 |
| 3,271,568 | 9/1966 | Lundberg | 40/545 |
| 3,753,458 | 8/1973 | Lazarek . | |
| 3,844,076 | 10/1974 | Schöck | 52/107 |
| 4,202,396 | 5/1980 | Levy . | |
| 4,270,292 | 6/1981 | Eckberg, II | 40/611 |
| 4,744,189 | 5/1988 | Wilson | 40/908 X |
| 4,896,467 | 1/1990 | McGinnis | 52/107 |
| 5,269,360 | 12/1993 | Chen . | |
| 5,426,879 | 6/1995 | Hecker | 40/564 X |

*Primary Examiner*—Joanne Silbermann

*Attorney, Agent, or Firm*—Charles F. Meroni, Jr.; Robert Toczycki

[57] ABSTRACT

A decorative window well shield for placement along an inner wall of a window well. The window well includes an upright wall structure set into ground opposite a window on an outer side of a building. The decorative window well shield includes a semi-flexible wall panel, the wall panel is sized to conform to an inner wall of a window well, and decorative indicia. The decorative indicia is carried on an exterior surface of the wall panel whereby the decorative window well shield can be placed along an inner wall of a window well with the decorative design facing a window providing a decorative visual display to a person viewing from a position inside a building through the window.

11 Claims, 3 Drawing Sheets

DECORATIVE WINDOW WELL SHIELD

FIELD OF THE INVENTION

The present invention relates generally to in ground window wells and more particularly to a decorative cover or shield to be set into the window well, outside the window and between the window and the inner window well wall to provide an aesthetic view.

The present invention provides a weather resistant decorative shield for placement into a window well to provide a more interesting or aesthetic view. The decorative shield may be self-supporting and resting against the inner window well wall or may be secured against the inner well wall. The decorative aspect of the present invention resides in a decorative scene imprinted on the cover of the decorative shield that creates a panoramic picture contoured to the inner wall of the window well. The picture or scene may be a cartoon scene, a landscape scene, a picture, artwork, or the like.

BACKGROUND OF THE INVENTION

Window wells are found in some homes which have basements. They are typically a semicircular pit, with the outwardly facing sides being defined by a semicircular sheet of corrugated steel, to provide an access opening for a basement window. Window wells are also commonly known as Area Walls.

Window wells are generally rather unsightly. When looking outside of a window having a window well, one typically sees a gray colored window well wall in the background and thereby providing an uninteresting or otherwise dull view of the window well. People may place plants or nicely colored rocks on the bottom of the window well to enhance the appearance through the window. In other cases the window is entirely covered up by window shades or the like to hide the uninteresting view of the window well.

These and other types of methods of decorating window wells or covering up windows having window wells do not offer the flexibility, decorativeness and inventive features of my decorative window well shield. As will be described in greater detail hereinafter, the decorative window well shield of the present invention differs from those previously proposed.

SUMMARY OF THE INVENTION

According to my present invention I have provided a decorative window well shield for placement along an inner wall of a window well, the window well includes an upright wall structure set into ground opposite a window on an outer side of a building, the decorative window well shield comprises a semi-flexible wall panel, the wall panel is sized to conform to an inner wall of a window well, and decorative indicia carried on an exterior surface of the wall panel whereby the decorative window well shield can be placed along an inner wall of a window well with the decorative indicia facing a window providing a decorative visual display to a person viewing from a position inside a building through the window.

Another feature of my invention relates to the decorative window well shield described above, wherein the decorative window well shield is comprised of a weather resistant material. Furthermore, wherein the wall panel is a material selected from the group consisting of: plastic, fiberglass, metal, vinyl and corrugated poly-vinyl PVC.

Still another feature of my invention concerns the decorative window well shield described above, wherein the upright wall structure of the window well is of D-shaped cross section.

According to important features of my invention I have also provided a decorative window well shield as described above, wherein the decorative window well shield is flexible enough to roll up into a cylindrical tube. Furthermore, wherein the window well shield comprises at least one semi-flexible wall panel Yet another feature of my invention I have provided a decorative window well shield as described above, wherein the decorative window well shield is secured with fasteners to the inner wall of the window well, the fasteners are selected from the group consisting of: adhesive, clips, hook and loop fasteners, and moldings.

According to still further features of my invention I have also provided a decorative window well shield as described above, wherein the decorative window well shield comprises a plurality of semi-flexible wall panel parts, the wall panel parts have a rectangular shape, and fasteners securing the wall panel parts in a side-by-side relation to the window well, thus providing the window well with a decorative appearance in the form of the indicia appearing on the inner side of the decorative window well shield.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
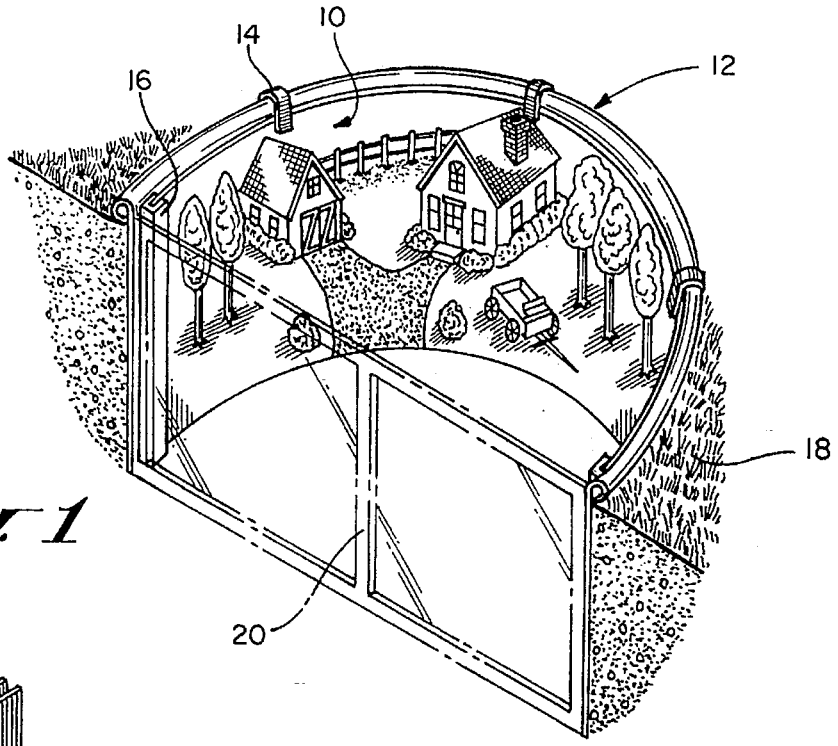
FIG. 1 is a perspective view of my decorative window well shield fastened along the inner wall of a window well embodying important features of my invention.
Figure 2:
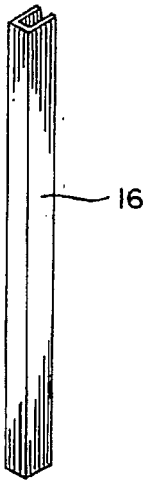
FIG. 2 is a perspective view of a fastener that can be used to secure my decorative window well shields to an inner wall of a window well.
Figure 3:
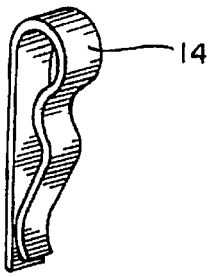
FIG. 3 is another type of a fastener or clip that can also be used to secure my decorative window well shields to an inner wall of a window well.

Referring now to the drawings, FIG. 1 shows my new Decorative Window Well Shield 10 secured in a window well 12 with fasteners 14, 16. The window well 12 is of the type set into ground 18 opposite a window 20 on an outer side of a building and typically has a D-shaped cross section. Various different fasteners can be used to attach the shield 10 to the window well. FIGS. 2 and 3 illustrate the types of fasteners used to secure the shield in FIG. 1. The shield 10 is sized to conform to an inner wall of the window well. The edges of the shield are inserted into a molding 14 to keep the shield in place. Clips 14 are further used to hold the upper edges of the shield against the inner wall of the window well.

Figure 4:
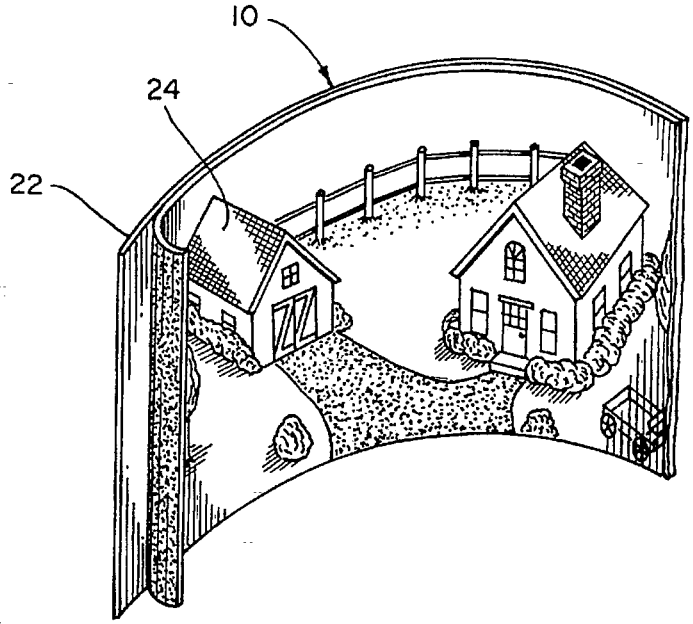
FIG. 4 is a fragmentary perspective view of one of my decorative window well shields illustrating the construction of my decorative shield.

The shield comprises a semi-flexible wall panel 22 (FIG. 4) and decorative indicia 24. The decorative indicia 24 can be applied to the wall panel 22 in numerous ways including, but not limited to: adhering the indicia to the wall panel; laminating the indicia to the wall panel; and even directly drawing the indicia onto the wall panel. The decorative indicia can include various types of drawings, photos, artwork or stickers to provide a visual display.

It is contemplated to provide a quality shield to withstand the various elements, weather conditions, insects and the like, thereby providing a shield that is made of a weather resistant and insect proof material. Various different materials could be used, including: fiberglass, plastic, metal, corrugated poly-vinyl PVC and vinyl. Excellent results can be obtained by using a fiberglass material known in the industry under the trademark "Structoglas". "Structoglas" can be obtained through Sequentia Incorporated, P.O. Box 360530, Cleveland, Ohio 44136. In addition, the shield can be coated with a waterproof coating, lamination, etc. to further protect it from the elements.

Figure 5:
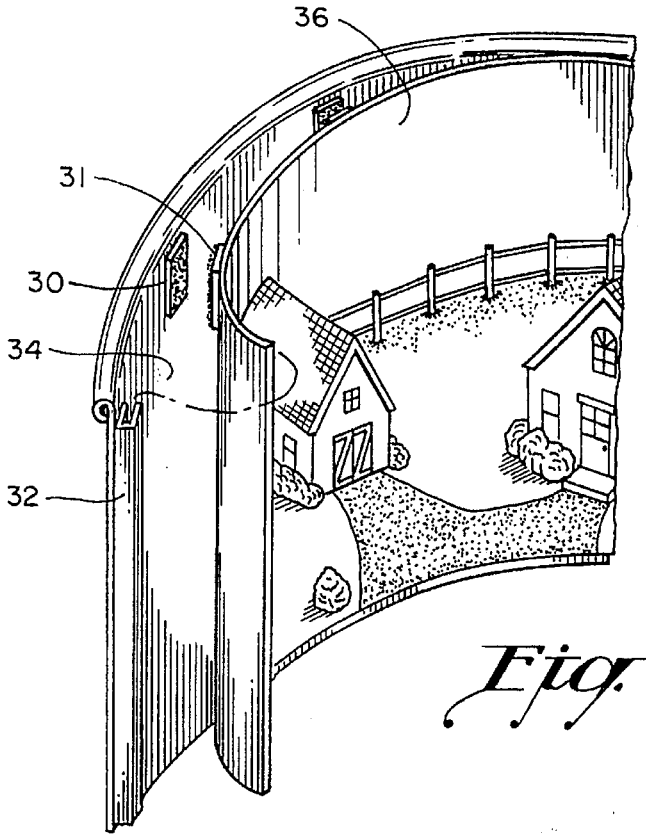
FIG. 5 is an enlarged fragmentary perspective view of one of my decorative window well shields illustrating another method of attaching my decorative device along an inner wall of a window well.
Figure 6:
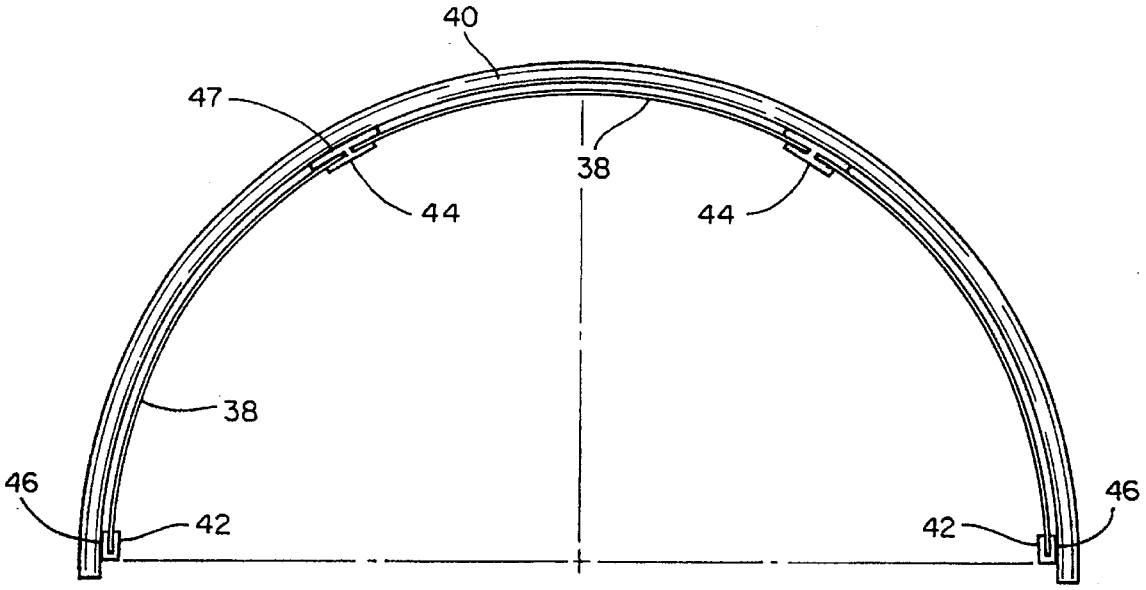
FIG. 6 is an enlarged top plan view illustrating another method of securing another version of my decorative window well shield along an inner wall of a window well embodying further important features of my invention.

The shield can be attached to the window well in various different ways or the shield can be just placed inside of the window well all by itself and remain self supporting within the window well. FIGS. 5 & 6 further illustrate other ways of fastening the shield to the inner wall of a window well. The shield should be installed such that the decorative indicia should face the window to provide a decorative visual display to a person viewing from a position inside the building through the window of the window well. Since the shield is located outdoors within the window well, it is also contemplated that the shield can be illuminated for viewing the shield at night. The illumination can be done by directing an external light from above the window well or on the bottom of the window well towards the decorative shield.

FIG. 5 illustrates the use of hook and loop fasteners 30, 31, commonly know under the trade name "Velcro", and moldings 32. The hook and loop fasteners 30, 31 can be attached to the inner wall 34 of the window well and to the back side of the shield 36. Additionally, moldings 32 can be placed at the outer edges of the window well to accept and hold the edges of the shield 36.

Figure 7:
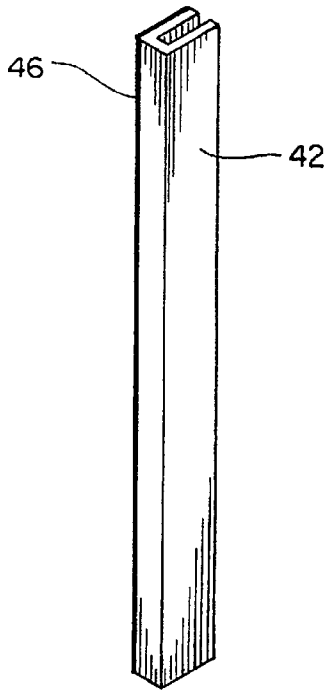
FIG. 7 is an enlarged perspective view of another type of a fastener that can be used to attach one of my decorative window well shields along an inner wall of a window well.
Figure 8:
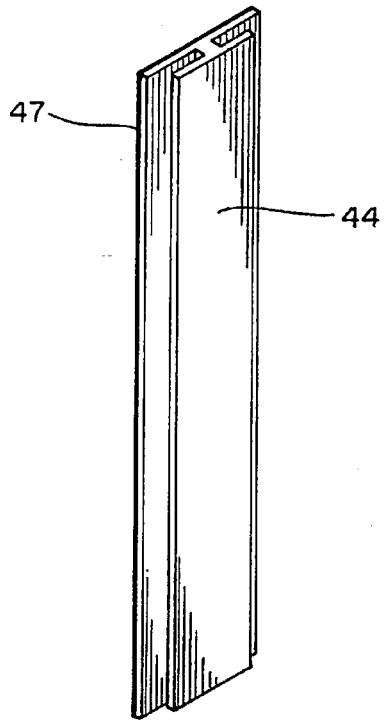
FIG. 8 is an enlarged perspective view of yet another type of a fastener that can be used to attach one of my decorative window well shields along an inner wall of a window well.

FIG. 6 illustrates another type of a decorative window well shield 38 that can be installed along the inner wall of a window well 40, wherein molding 42, 44 are used to hold a plurality of wall panels of the shield (FIGS. 6–8). The plurality of the wall panels taken together can also provide a decorative visual display. The moldings 42, 44 are secured to the inner wall of the window well 40 with adhesive 46, 47. The wall panels are of a rectangular shape and are inserted in between the moldings on the window well. This type of a configuration may be more suitable for larger window wells or window wells with differentiating shapes.

The various different fastening devices herein disclosed offer the flexibility of interchanging the decorative shields within the window well to provide a variety of decorations. These decorations could be changed by the user according to the season, a holiday, a birthday, etc. thereby providing a decorative view within a basement window with variety. The fastening devices disclosed herein, which include: adhesive, clips, hook and loop fasteners and moldings, can be of a generic variety and can be typically purchased at a local hardware store. It is contemplated that various other types of fastening devices could be used to secure a decorative window well shield within a window well.

Figure 9:
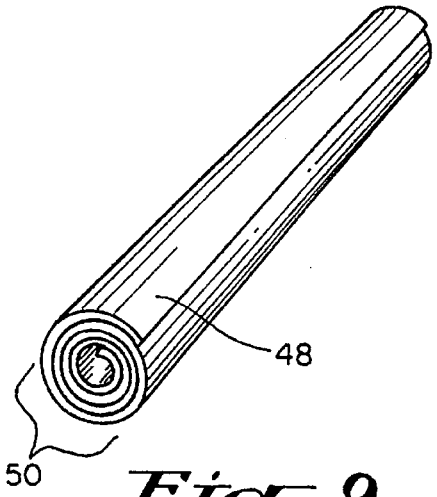
FIG. 9 is a perspective view of my decorative window well shield illustrating how it can be rolled up.

Since not all window wells have the same shape or size, the shield 10 can be cut by scissors or a knife to conform to the size of the inner wall of the window well. To provide easy storage, sale and shipping of the decorative window well shield, it is desired that the shield 48 be flexible enough to roll into a cylindrical tube 50 as shown in FIG. 9. This enables the formation of a compact decorative window well kit for sale and easy installation by a user at their residence. The kit can further include materials required to install the decorative window well shield as well as a light for illuminating the shield at night. Excellent results can be obtained when the thickness of the shield is between 0.0625 inches and 0.25 inches.

Figure 10:
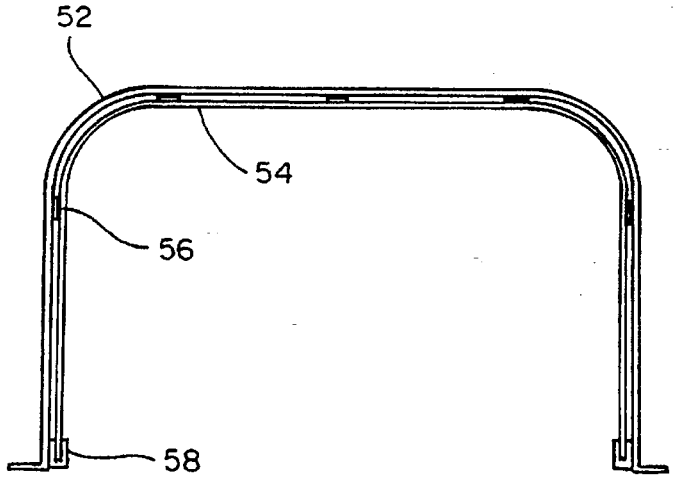
FIG. 10 is a top plan view of one my decorative window well shields illustrating how it can be secured to another type of a window well.

The shield should be flexible to allow it to conform to the inner wall of a window well. FIG. 10 illustrates a different shape of a window well 52 showing how the shield with the fasteners 56 and moldings 58. It may be necessary to heat the shield, such as with a regular household hair dryer, to bend the shield at critical comers.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. In combination, a decorative window well shield and a window well, said window well including an upright wall structure set into ground opposite a window on an outer side of a building, said decorative window well shield being attached in an upright position in abutting engagement against an inner wall of said upright wall structure, said decorative window well shield comprising a semi-flexible wall panel, said wall panel being sized to substantially cover the inner wall of the upright wall structure, and decorative indicia carried on an exterior surface of the wall panel facing the window, thereby providing a decorative visual display to a person viewing from a position inside the building through the window.

2. The combination of claim 1, wherein said decorative window well shield is comprised of a weather resistant material.

3. The combination of claim 1, wherein said wall panel is a material selected from the group consisting of: plastic, fiberglass, metal, vinyl and corrugated poly-vinyl PVC.

4. The combination of claim 3, wherein said decorative window well shield has a thickness between 0.0625 inches and 0.25 inches.

5. The combination of claim 1, wherein said upright wall structure of the window well is of D-shaped cross section.

6. The combination of claim 1, wherein said decorative window well shield is flexible enough to roll up into a cylindrical tube.

7. The combination of claim 1, wherein said decorative window well shield comprises at least one semi-flexible wall panel.

8. The combination of claim 1, wherein said decorative window well shield is secured with fasteners to the inner wall of the upright wall structure, said fasteners being selected from the group consisting of: adhesive, clips, hook and loop fasteners, and moldings.

9. The combination of claim 1, wherein said decorative window well shield comprises a plurality of semi-flexible wall panel parts, said wall panel parts having a rectangular shape, and fasteners securing said wall panel parts in a side-by-side relation to said window well, thus providing the window well with a decorative appearance in the form of the indicia appearing on the inner side of said decorative window well shield.

10. A kit for decorating an inside wall of a window well set into ground opposite a window on an outer side of a building including, a decorative window well shield and fasteners, said decorative window well shield being attached with the fasteners in an upright position in abutting engagement against an inner wall of said window well, said fasteners being selected from the group consisting of: adhesive, clips, hook and loop fasteners, and moldings, said decorative window well shield comprising a semi-flexible wall panel, said wall panel being sized to substantially cover the inner wall of the window well, and decorative indicia carried on an exterior surface of the wall panel facing the window, said decorative window well shield also being flexible enough to roll up into a cylindrical tube thereby providing a compact kit for decorating a window well of a building.

11. The kit for decorating an inside wall of a window well of claim 10, wherein said decorative window well shield comprises a plurality of semi-flexible wall panel parts, said wall panel parts having a rectangular shape, and fasteners securing said wall panel parts in a side-by-side relation to said window well, thus providing the window well with a decorative appearance in the form of the indicia appearing on the inner side of said decorative window well shield.

* * * * *